United States Patent [19]

Sitarski et al.

[11] Patent Number: 4,805,258

[45] Date of Patent: Feb. 21, 1989

[54] BATTERY POWERED WALK BEHIND FLOOR BURNISHER

[75] Inventors: Gerald P. Sitarski, Grand Island; Barry A. May, North Tonawanda, both of N.Y.

[73] Assignee: Tennant Trend Inc., Niagara Falls, N.Y.

[21] Appl. No.: 99,542

[22] Filed: Sep. 22, 1987

[51] Int. Cl.[4] ..... A47H 11/20

[52] U.S. Cl. ..... 15/385; 15/49 R; 15/230.17

[58] Field of Search ..... 15/385, 320, 49 R, 50 R, 15/230.17, 372, 339

[56] References Cited

U.S. PATENT DOCUMENTS

| | | | |
|---|---|---|---|
| 935,558 | 9/1909 | Spangler | 15/385 X |
| 1,093,820 | 4/1914 | Beach | 15/385 X |
| 2,415,372 | 2/1947 | Salt et al. | 15/385 X |
| 3,105,991 | 3/1961 | Oberg | 15/320 |
| 3,436,788 | 4/1969 | Tamny | 15/340 |
| 3,619,954 | 11/1971 | Miller | 51/170 T |
| 4,115,890 | 9/1978 | Burgoon | 15/49 R |
| 4,122,576 | 10/1978 | Bevington et al. | 15/49 R |
| 4,148,110 | 4/1979 | Moen | 15/385 |
| 4,178,654 | 12/1979 | Mitchell | 15/385 |
| 4,218,798 | 8/1980 | Block | 15/49 R |
| 4,358,868 | 11/1982 | Cook, Jr. | 15/49 R |
| 4,490,873 | 1/1985 | Stratton | 15/320 X |
| 4,492,002 | 1/1985 | Waldhauser et al. | 15/320 |
| 4,598,440 | 7/1986 | Wilson | 15/385 |
| 4,608,727 | 12/1984 | Schwab | 15/98 |
| 4,631,775 | 10/1985 | Palmer et al. | 15/385 |
| 4,674,142 | 6/1987 | Meili | 15/320 X |
| 4,701,976 | 10/1987 | Palmer et al. | 15/385 |
| 4,715,087 | 12/1987 | Todd et al. | 15/385 |
| 4,720,886 | 1/1988 | McLeod et al. | 15/385 X |
| 4,731,956 | 3/1988 | Wood | 15/385 X |

OTHER PUBLICATIONS

Advance Machine Company, Whirlamatic 2500, Feb. 1987, 2 pages.

*Primary Examiner*—Chris K. Moore

*Attorney, Agent, or Firm*—Christel, Bean & Linihan

[57] ABSTRACT

A battery powered walk behind floor burnishing unit (10). The unit includes a main frame (12) supported by wheel means (18, 20, 36), the main frame being capable of supporting a plurality of batteries (14). At least one of the wheels (18) may be driven. A burnisher subassembly (22) is mounted on the rear of the frame by a mounting assembly for movement through an from a raised inoperative position through an intermediate ready position to a lowered operative position. The burnisher subassembly includes a drive head (80) and a rotatable drive block (94), the drive block being capable of being rotated by a motor (24) mounted on the drive head. The mounting assembly includes two pairs of parallel links (126, 128) and biasing means (140, 142) which normally biases the subassembly (22) to the raised inoperative position. A vacuum apparatus includes an open cell burnishing pad (114) carried by the burnisher subassembly. The vacuum apparatus is capable of maintaining the burnisher subassembly (22) in contact with a floor during operation of the motor (24), and is also capable of moving the burnisher subassembly into contact with the floor when the motor is operated and the burnisher subassembly is in its ready or intermediate position. Operator controls (182, 184) are provided at the rear of the machine above the burnisher subassembly.

17 Claims, 6 Drawing Sheets

12.6
222
223
221
80
86
130
134
136
138
126
128
216
24
20
90
89
94
122
120
98
106
104
108
110
102
100
112
114
96
116
118
124
92
170
164
166
168

BATTERY POWERED WALK BEHIND FLOOR BURNISHER

TECHNICAL FIELD

The present invention relates generally to floor maintenance equipment, and more particularly to a battery powered walk behind floor burnisher.

BACKGROUND OF THE INVENTION

Floor burnishing machinery is well known in the art and typical U.S. Pat. Nos. relating to such machines are 4,115,890, 4,122,576, 4,358,868, 4,598,440 and 4,631,775.

All prior art battery powered burnishing machines have the disadvantage in that the burnishing pad is mounted to the front, the machine having wheels to the rear of the pad. Thus, the last part of the machine to touch the floor is the wheels and all to often the result is wheel marks on freshly burnished floors.

Prior art battery powered machines in addition do not have a system which incorporates a free floating burnisher subassembly which can maintain uniform amperage draw on the batteries during operation, and which amperage draw can be varied over a range by increasing or decreasing the pressure on the floor to provide for long running times for well maintained floors and more burnishing power for poorly maintained floors.

Also, in prior art burnisher machines which have a self-contained power source, the burnishers are mounted on the longitudinal center line of the machine. This makes it difficult to burnish under cabinets, equipment and similar obstructions.

OBJECTS OF THE INVENTION

It is an object of the present invention to provide a walk behind floor burnisher which overcomes many of the disadvantages of prior art machines.

More specifically, it is an object of this invention to provide a walk behind floor burnisher which includes a burnisher subassembly mounted to the rear of the machine by linkage means for movement from a raised inoperative position through an intermediate ready position to a lowered operative position, biasing means which engage the linkage means to bias the burnisher subassembly upwardly to either the raised inoperative position or the intermediate ready position, and vacuum means which, during operation, exerts a downward force sufficient to overcome the force exerted by the biasing means when the burnisher subassembly is either in its ready position or in contact with the floor. The vacuum means, which consists essentially of an open cell burnishing pad, is caused to be operational when the burnisher pad is being rotated at normal operational speeds. When the vacuum means is being operated it is capable of initially moving the burnishing subassembly downwardly from its ready position to its fully lowered burnishing position, and, once the burnishing subassembly is in its burnishing position, the vacuum means is capable of maintaining the burnisher pad in contact with the floor with a consistent amperage draw.

It is a further object of the present invention to provide a walk behind floor burnisher wherein the burnisher is disposed to the rear of the machine and is laterally offset to one side of the longitudinal center line of the main frame of the machine.

It is a further object of the present invention to provide a battery powered walk behind floor burnisher wherein the burnisher is mounted to the rear of the machine for movement through an intermediate ready position between a raised inoperative position and a lowered operative position, and further including a sensing means which will not permit the burnisher to be rotated when in its raised inoperative position.

It is yet another object of this invention to provide a battery powered walk behind floor burnisher wherein the operator controls are disposed to the rear of the machine and above the burnisher.

These and other objects and advantages of the present invention will become more apparent after a consideration of the following detailed description taken in conjunction with the accompanying drawings in which a preferred form of this invention is illustrated.

DETAILED DESCRIPTION

In General

Figure 1:
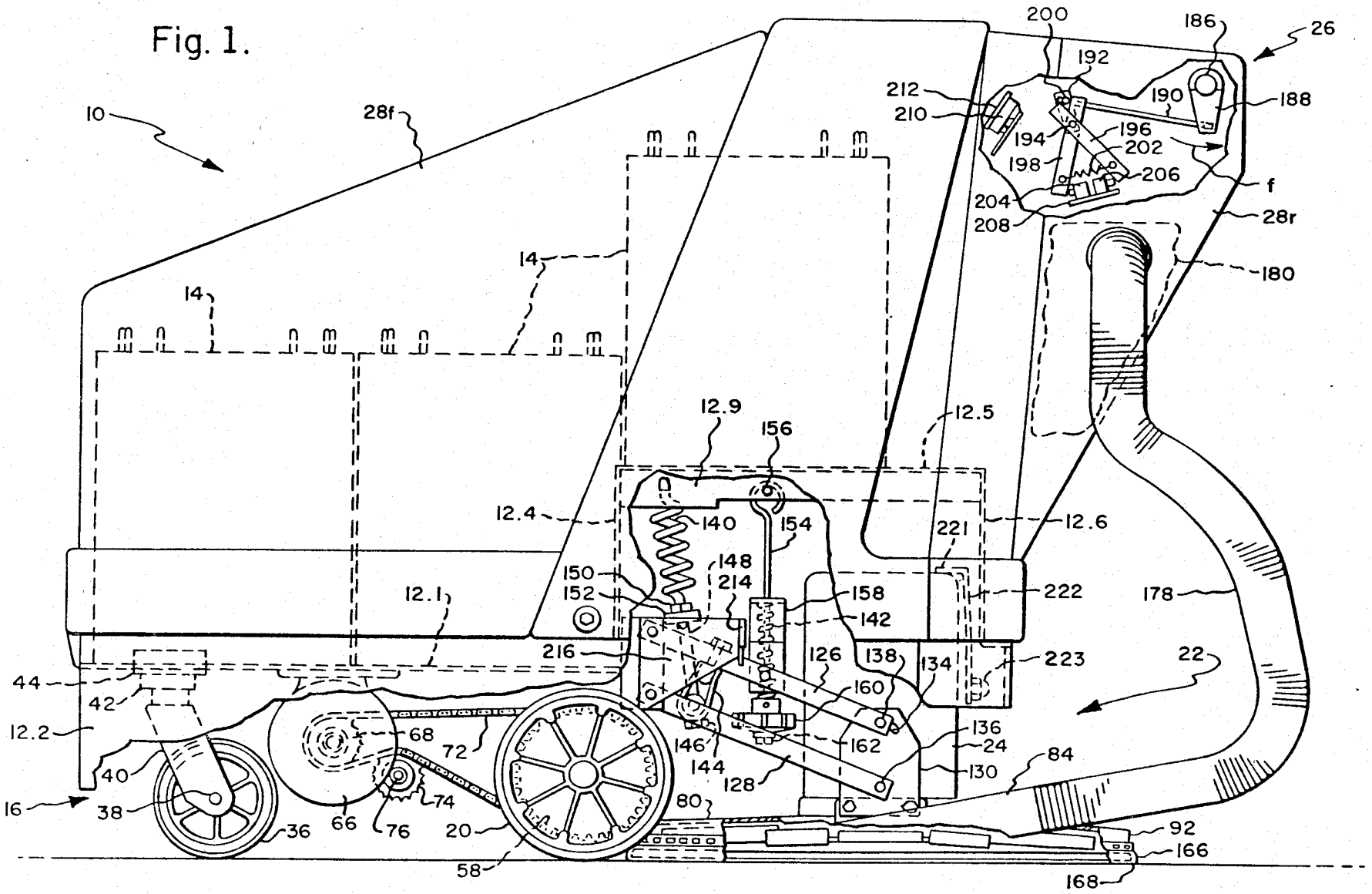
FIG. 1 is a side view of the battery powered walk behind floor burnisher of this invention, parts being broken out to better illustrate the invention.

The walk behind battery powered floor burnisher of this invention is indicated generally at 10. It includes a main frame 12, which is adapted to support a plurality of batteries 14, which batteries are the power source for the machine. The main frame is supported for movement over a floor by wheel means in the form of a front caster wheel assembly, indicated generally at 16, and a pair of laterally spaced apart rear wheels 18, 20. In the preferred illustrated embodiment one of the wheels is powered to make the burnishing machine self-propelled. A burnisher subassembly, indicated generally at 22, is mounted to the rear of wheels 18 and 20 by linkage means which will permit the burnisher subassembly to be moved from a fully raised inoperative position shown in FIG. 7, to a lowered burnishing position, the later position being shown in FIG. 1. A burnisher pad drive means, in the form of a battery driven electric motor 24, is mounted on the burnisher subassembly 22. The burnisher sub-assembly mounting means includes, in addition to the previously mentioned linkage means, biasing means which are capable of biasing the burnisher subassembly and the drive means towards the raised inoperative position. Vacuum means are associated with the burnishing subassembly and will maintain the burnisher subassembly in contact with the floor during normal operation of the burnisher. Dust collecting means are associated with the vacuum means for collecting dust raised during the burnishing operation. Finally, an operator's control station, which is indicated generally at 26, is mounted to the rear of the machine above the burnisher subassembly.

The Frame

The main frame 12 is made of various components which are welded to each other in a manner not material to this invention. Major components of the frame are a lower forward horizontal support portion 12.1, left hand and right hand side panels 12.2 and 12.3, respectively, (FIG. 2) which are joined together at the rear of the frame, an intermediate vertical portion 12.4, an upper rear horizontal support portion 12.5, and a rear vertical portion 12.6. The frame also includes right and left L shaped brackets 12.7 and 12.8 which extend rearward from the vertical portion 12.4 and right and left rear platform supports 12.9 and 12.10. The frame, as well as the batteries and all internal components are covered by shrouds 28 there being a front shroud 28f and a rear shroud 28r. A wall roller bracket 30 (FIG. 2) is secured to the front end of the frame and in turn carries right and left wall rollers 32, 34, respectively.

The Wheel Means and Wheel Drive

The front caster wheel assembly 16 includes a wheel 36 which is journaled upon an axle 38 received within a yoke 40. A rotatable bearing assembly 42 is carried by the bight portion of the yoke 40 and in turn is secured to an upper mounting flange 44. A caster mounting reinforcement plate 46 (FIG. 2) is welded to the top surface of the lower horizontal support portion 12-1 of the main frame, and the mounting flange 44 is in turn secured to the frame and its reinforcement 46 by bolts 48.

Figure 2:
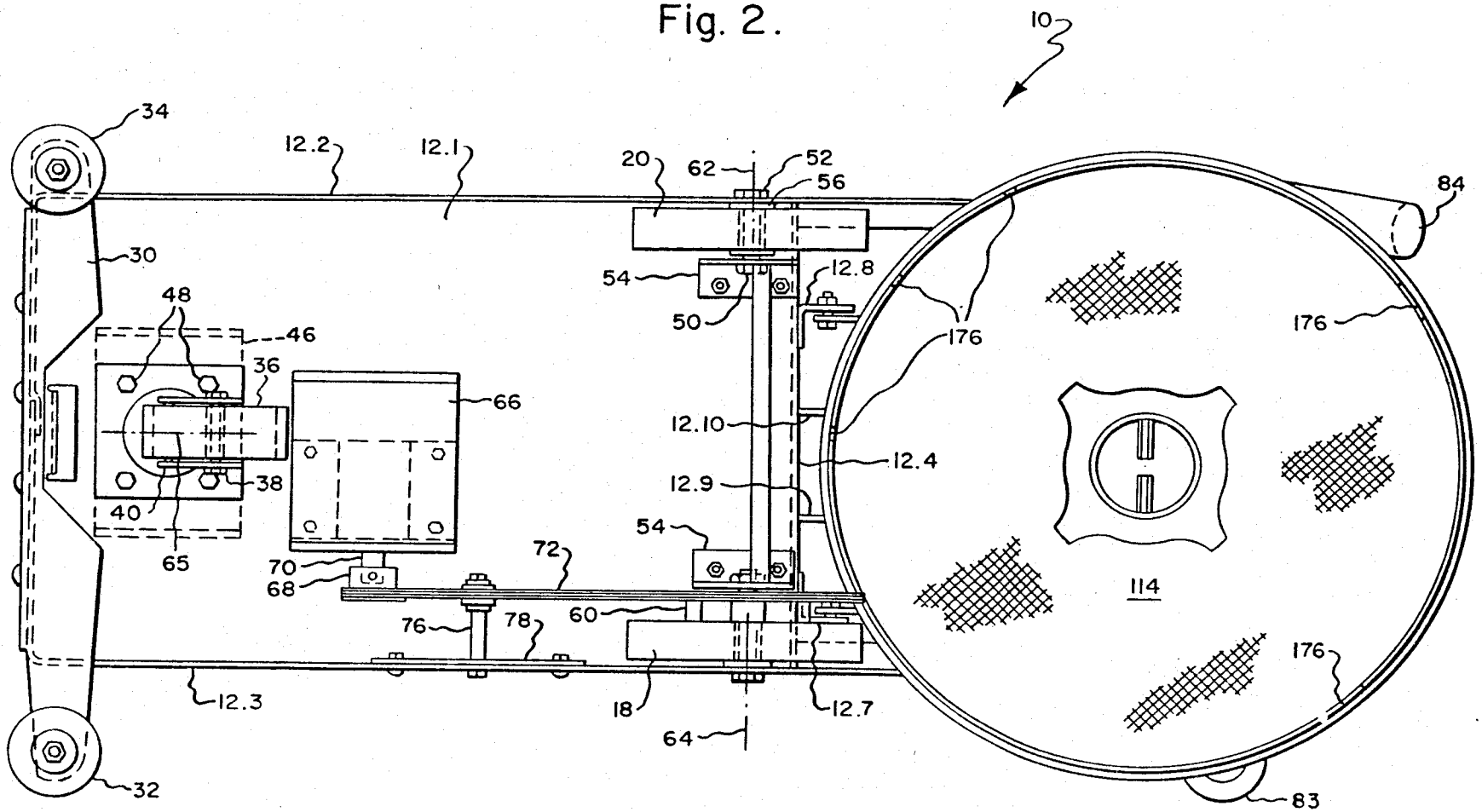
FIG. 2 is a bottom view of the burnisher shown in FIG. 1.

As can best be seen from FIG. 2, the left rear wheel 20 is supported on the frame 12 by means of a nut and bolt 50, 52 which pass through aligned apertures in the left hand side panel 12.2 the frame and a wheel mount bracket 54. The bolt 52 supports a wheel bearing 56 which receives the wheel 20. The right hand wheel 18 is mounted in a similar manner on right hand side panel 12.3 and another wheel mount bracket 54 but the right hand wheel in addition carries a sprocket 58 (FIG. 1) which is secured to the wheel by four sprocket mounting screws 60 which are spaced away from each other by 90°. As can be seen from FIG. 2 the center line 62 for the left wheel 20 is spaced to the rear of the center line 64 for the right wheel 18. This permits the left wheel to be more closely spaced to the burnisher subassembly, which is offset from the center line 65 of the frame to the right hand side as can be seen from FIG. 2, and also provides for better operation of the unit when the machine is propelled over cracks in the floor which are transverse to the direction of movement of the machine. This also allows improved weight distribution by positioning wheel center line as far back to rear of machine as possible.

A drive motor 66 is suitably bolted to the lower horizontal support portion 12.1 of the frame, and a drive sprocket 68 is mounted on the output shaft 70 of the motor. A chain 72 extends from the drive sprocket 68 to the driven sprocket 58 and is held in proper tension by an idler sprocket 74 which is mounted on shaft 76 carried by support 78 which is adjustably secured to the right hand side panel of 12.3 of the frame. It should be obvious from FIG. 1 that if the output shaft of the motor 66 were rotated in a clockwise direction that the machine would be propelled in a forward direction, to the left in FIG. 1. Only one of the wheels 18, 20 is driven, thus avoiding the requirement for a differential drive between the wheels as would be necessary when the machine is turning.

The Burnisher Subassembly

Figures 5, 7:
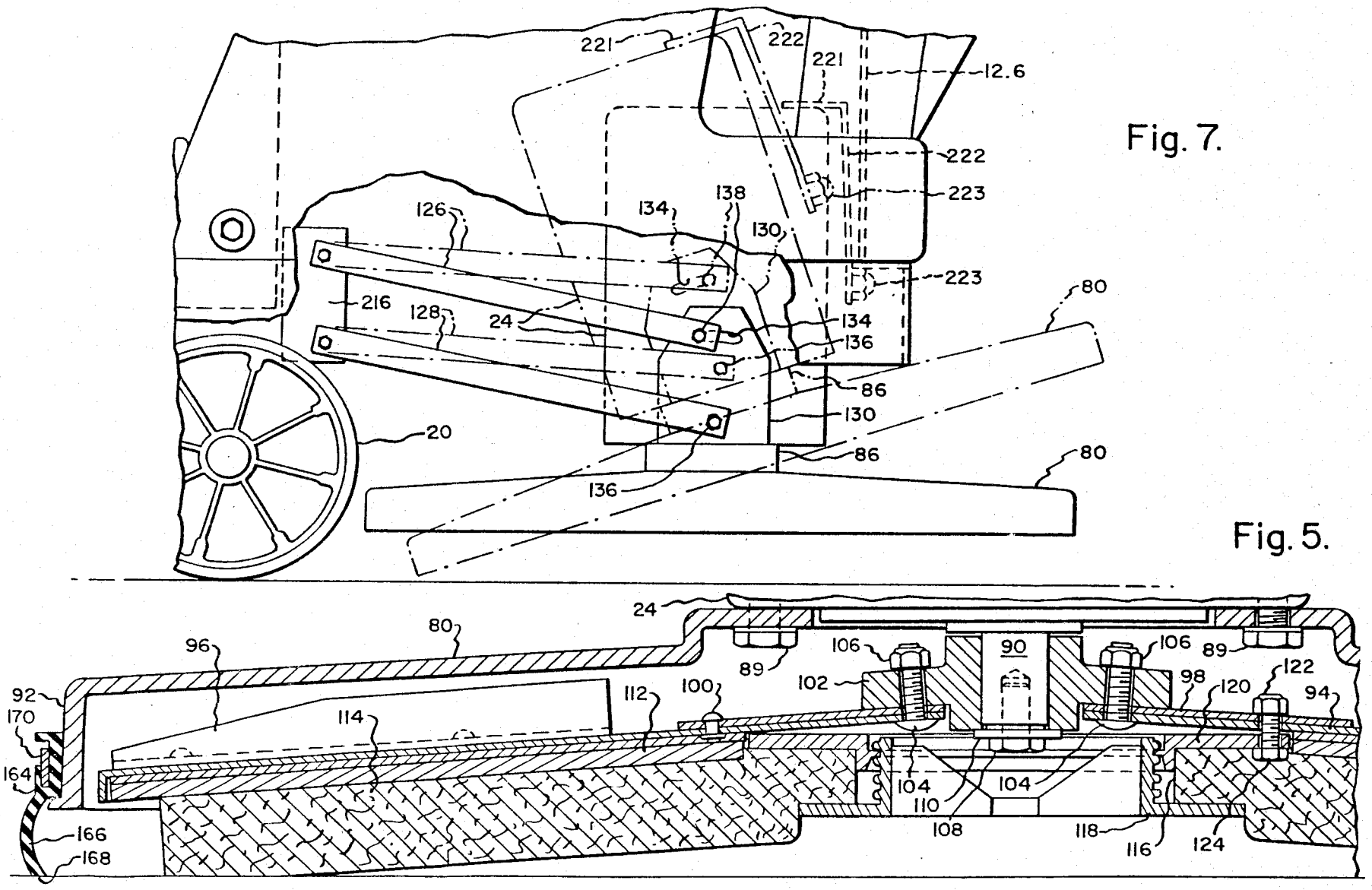
FIG. 5 is a sectional view taken through a portion of the burnisher.
FIG. 7 is a side view showing the burnisher subassembly it its intermediate ready position in full lines and in a fully raised position in phantom lines.
Figure 6:
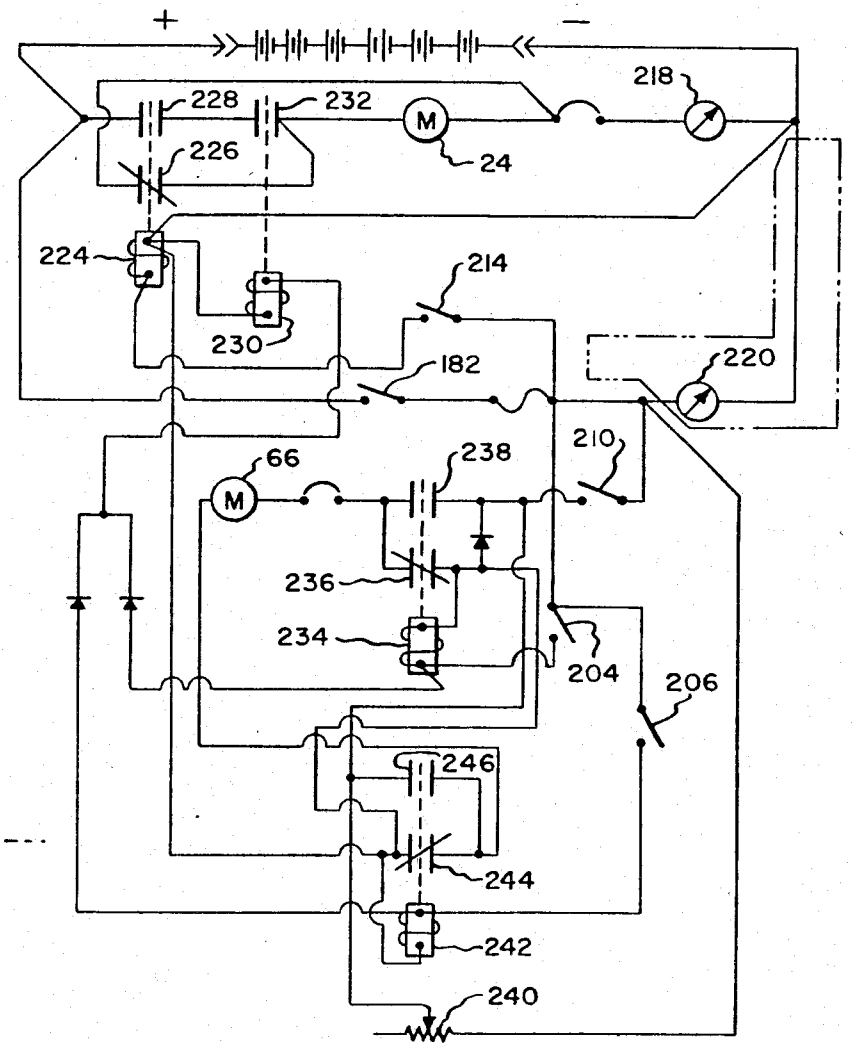
FIG. 6 is an electrical diagram.

The burnisher subassembly 22 (FIGS. 4 and 5) includes a rigid drive head 80 provided with a foot pad 82 along its rear top surface and a wall roller 83 along its right hand top surface. The drive head 80 is preferably made from an aluminum casting or the like and has molded into it an air discharge outlet 84, and a pair of laterally upwardly extending bracket receiving ears 86 located about a central aperture 88. The pad drive motor 24 is adapted to be mounted directly onto the drive head by bolts 89 with its output shaft 90 extending through the aperture 88. The drive head 80 is provided with a downwardly extending peripheral flange 92 and mounted within the flange is a pad drive block 94. Mounted on the top of the pad drive block are a plurality of fins 96. As best shown in FIG. 5 the drive block is provided with a central stiffener 98 which is held in place by pop rivets 100. Secured to the central aperture of the drive block 94 and the stiffener 98 is a drive block hub 102 which is secured in place by carriage screws and nuts 104, 106. The output shaft 90 of the motor 24 is suitably keyed to the drive hub block 102 and the parts are finally assembled by a hexhead screw 108 and washers 110, the screw 108 being received within a threaded aperture in shaft 90. The downwardly facing side of the pad drive block 94 is provided with conventional facing material 112 which is capable of engaging a burnishing pad 114 for causing the pad to rotate with the drive block. The pad is of an open cell design for reasons which will be brought out below. The pad 114 is provided a central aperture 116 and is secured in place by means of a removable center lock 118 which is screwed into a center lock receiving member 120 provided with a threaded aperture, the center lock receiving member 120 in turn being secured to the drive block 94 and stiffener 98 by nuts and bolts 122, 124. It should be apparent from the above that when the output shaft 90 of the motor 24 is rotated that the burnishing pad 114 will also be rotated.

The Linkage Means

Figure 4:
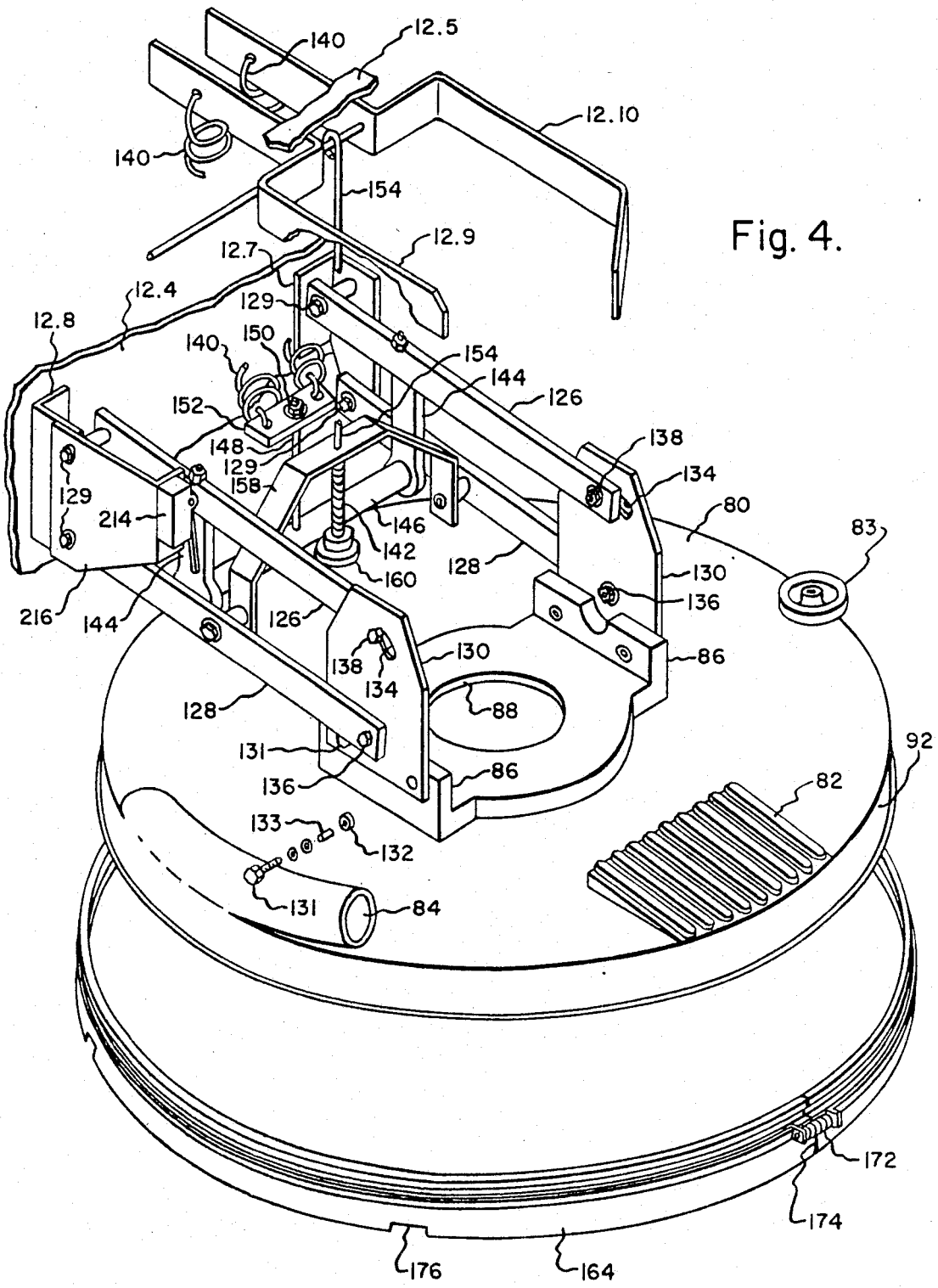
FIG. 4 is a partially exploded isometric view of a portion of the burnisher, this view being taken from the left rear of the machine.

The linkage means, which forms part of the mounting means for the burnisher sub assembly is best illustrated in FIG. 4. As can be seen from this Figure, two pairs of parallel links are utilized to secure the drive head for movement between a raised inoperative position and a lowered operative position. Each pair of parallel links includes an upper link 126 and a lower link 128. As can be seen from FIG. 4 the upperlinks 126 are more closely spaced together than the lower links 128. The forward ends of the links are secured to the L-shaped brackets 12.7 and 12.8 on the main frame by forward pivot pin assemblies 129 including suitable fasteners and spacers in such a manner that the links 126, 128 can pivot with respect to the frame 12. The rear ends of the links 126 and 128 are in turn secured by rear pivot pin assemblies to upwardly extending brackets 130 which are in turn secured to the ears 86 by mounting assemblies which include bolts 131, grommets 132, and sleeves 133, the bolts 131 being received within tapped holes in ears 86. A grommet 132 is disposed about a sleeve 133 which is in turn disposed about each bolt 131, the grommets isolating the brackets 130 and links 126, 128 from vibrations caused in the pad driver and also allowing additional side to side float of the drive head. Each of the brackets 130 is provided with vertically spaced apart pivot pin receiving means, and thus the brackets are provided with a lower aperture (no number) and an upper arcuate slot 134. The rear end of each of the lower links 128 carries a suitable rear pivot pin assembly 136 including a bolt, nut, bearing journal, and suitable washers, which pivot pin assembly 136 passes through the lower pivot pin receiving means on the associated bracket 130. Similarly, the rear ends of each of the upper links carries a pivot pin assembly 138 which passes through slot 134, the pivot pin assembly 138 including a bolt, nut, bearing journal and suitable washers. It can be seen from FIG. 4 that the lower links extend to the outside of the brackets 130 and the upper links are disposed to the inner sides of the brackets 130. By providing the arcuate slot 134 the burnisher subassembly will be permitted to rock about a transverse axis defined by the lower pivot pin assemblies 136 to conform to surface irregularities in the floor to be burnished, and, when the burnisher subassembly is in its intermediate ready position, the slots will also permit the burnisher subassembly to be tilted to an angle of approximately 20° with respect to the machine as shown in dotted lines in FIG. 7 to permit burnisher pad replacement. The linkage is so designed that the burnisher subassembly may also tilt to a limited extent from side to side. Thus, by using the two pairs of parallel links, the arcuate connection for the rear ends of the upper links, and grommets 132 the burnisher subassembly may conform very closely to the surface of the floor at all times during burnishing.

The Biasing Means

The burnisher subassembly is normally biased to a raised position by biasing means which includes first and second springs 140, 142. As can best seen from FIG. 1 and 4, the upper ends of the springs 140 are received within suitable apertures in the supports 12.9 and 12.10 of the main frame. In order to secure the lower ends of the springs 140, each of the upper links 126 is provided with a suitable vertically extending aperture which receives a rod mounting assembly 144. A rod 146 extends between the rod mounting assemblies and it is provided with a suitable aperture midway between its ends which in turn receives a long bolt 148. Secured to the upper end of the bolt 148 by a suitable nut 150 is a cross plate 152 which is provided with suitable apertures at its ends to receive the lower ends of the springs 140. The second spring 142 is a compression spring and is disposed about an eye bolt 154, the upper end of the eye bolt being carried by a transverse pin 156 which is in turn suitably supported by the portions 12.9 and 12.10 of the main frame. The lower end of the eye bolt passes through the upper end of a U-shaped bracket 158, the lower ends of the bracket being supported on an intermediate location of each of the lower links 128 by suitable fasteners (not shown) which allow the bracket to rotate with the arc of head travel. A knob 160 for adjusting the force of the spring 142 is mounted on the lower threaded end of the eye bolt 154. A lock nut 162 is mounted on the lower end of bolt 154 and acts as a lower stop to prevent the knob 160 from being removed from the eyebolt 154. The tension of the springs 140 is typically factory adjusted by turning the lock nut 150. However, the force exerted by the spring 142 can be adjusted by the principal operator of the floor burnishing machine. In any event, the force of the combined springs 140, 142 is sufficient to bias the burnisher subassembly 22 upwardly, except during normal operation of the vacuum means.

The Vacuum Means and Dust Collecting Means

Vacuum means are provided which, during normal operation, will either move the burnisher subassembly downwardly from the intermediate ready position to the burnishing position, or, when the burnisher subassembly is in its burnishing position, will maintain the burnisher subassembly 22 in contact with the floor. The vacuum means is operable during operation of the pad drive motor 24. The vacuum means includes essentially only the open cell burnishing pad 114.

The dust collecting means is formed of various components, these including the air discharge outlet 84 on the top of the discharge head 80, fins 96 which provide a satisfactory air flow through the outlet 84, and a rubber skirt 164, the lower edge of which is placed into contact with the floor when the burnisher subassembly is forced into its lowered operating position by the vacuum means. The rubber skirt 164 is provided with a lower bellows shaped portion 166 which insures good conformability with the floor to insure that the very bottom edge 168 of the skirt is maintained in contact with the floor. The skirt is provided with a groove which receives a steel band 170, the purpose of the steel band being to secure the rubber skirt 164 to the flange 92. As can be seen in FIG. 4, the ends of the steel band are provided with clamping means 172 of a type utilized to secure radiator hoses in an automobile. In order to control air flow into the area below the pad 114, the ends of the rubber skirt are joined together by a suitable cement indicated at line 174.

Figure 8:
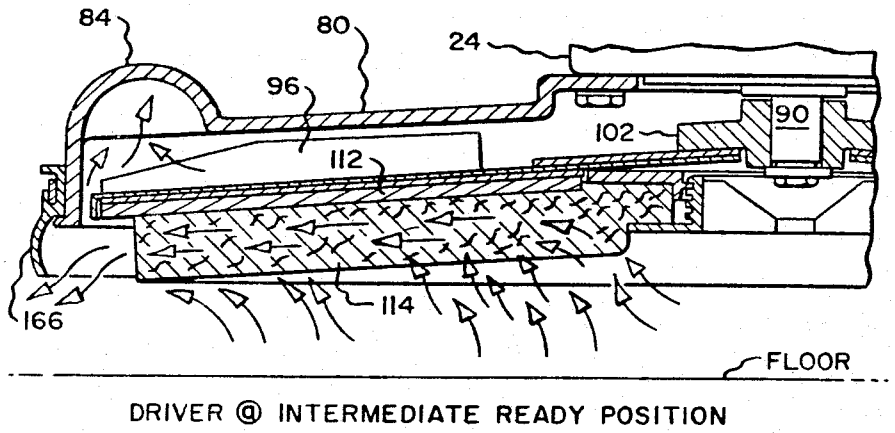
FIGS. 8 and 9 are views similar to FIG. 5 showing air flow patterns during operation of the vacuum means when the burnisher is in its ready position and when it is in its lowered operative position.

When the motor 24 is running and the burnisher subassembly is in its intermediate ready position the centrifugal force of the open cell pad 114 creates air movment along the outside surface of the pad as well as through the open cells in the pad. This air movement creates a negative pressure under and inside the pad which creates a downward force to overcome the force of springs 140, 142 and will force the pad to the floor. As the negative pressure is much greater in the center of the pad, it is necessary to provide the centerlock 118 to hold the pad to the drive block 94 and prevent it from pulling off the drive block. The centerlock also keeps the horizontal stretch of the pad (caused by the centrifugal force) to a minimum. The negative pressure created by the air discharge outlet 84 and fins 96 of the dust collecting means has little to no effect in creating a downward force when the pad is in the ready position. If the pad is removed from the pad driver, the air flow and negative force created by the pad driver, as well as the fins 96 and discharge outlet 84, is not sufficient to overcome the force of springs 140, 142. For this application the pad must be of an open-cell design, as the pad surface alone will not provide adequate air flow and negative pressure to overcome the spring force. Presently all the pads available on the market today are of an open-cell design. The air flow pattern when the subassembly 22 is in its ready position is shown in FIG. 8.

Once the burnisher subassembly has been moved to its lowered operating position rotation of the open cell pad will continue to establish vacuum under the burnisher subassembly 22. Thus, the negative pressure in and under the pad maintains a consistent force which holds the pad in contact with the floor. This force remains very consistent with floor variations as the design of the spring position and linkage will not allow much spring tension variations as the head floats up and down over floor variations.

The head skirt 164 provides a seal to the floor and allows the dust which may be created by the pad to be confined within the volume defined by the floor, skirt 164 and head 80 until it is discharged through the air discharge outlet 84. The provision of the air discharge outlet assures that a negative pressure will be maintained during operation of the vacuum means, air and dust being pulled under the skirt and from the area of the pad 114, the dust and air moving upwardly between the inner surface of flange 92 and the perifery of the pad drive block 94, the dust laden air then being discharged through outlet 84. When the unit is working upon a relatively smooth surfaced floor, the skirt additionally acts as an air valve which controls the vacuum under the burnisher subassembly. Thus, when the vacuum increases to certain point, air (as well as any dust on the floor outside of the burnisher subassembly) will be drawn in under the skirt, thereby reducing the vacuum and permitting the skirt to seal again. This cycle continues to be repeated at frequent intervals, due to the relatively large volume of air discharged through the outlet 84, thereby insuring proper ongoing operation of the unit and satisfactory dust collection. Because of the relatively high cycle frequency of the skirt valve action, the amperage draw will be maintained at a substantially constant level. It is important that the skirt is provided with the bellows portion 166 to insure good conformability with the floor when moving over uneven floors, as well as to insure good contact with the lower edge of the skirt when using pads of differing thickness. The skirt must also be of a very flexible material so it allows air and dust to enter under it into the burnishing head.

Figure 9:
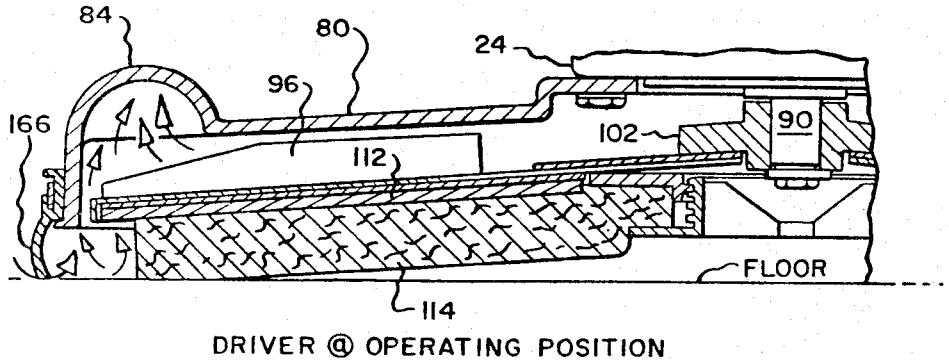

The negative pressure assured by the air discharge outlet 84 is very critical when the burnisher subassembly is in the burnishing mode as too much negative pressure will create a need for excessive spring tension, which will increase the force required for automatic pull down of the head. Too little negative pressure will not allow air to be pulled in under the skirt. These factors can be controlled by the diameter of the outlet 84, the placement of the outlet, by the pad RPM, as well as or by controlling the amount of air being pulled in under the skirt. The air flow pattern when the subassembly 22 is in its lower position is shown in FIG. 9.

In some applications the amount of air flow generated by the pad may not be adequate (such as at lower pad speeds or applications requiring more air flow and negative pressure). These applications require the use of fins 96. The additional air flow and negative pressure needed can be supplied and regulated by the combination of fin quality, fin size and pad speed. In addition, the fins 96 in some applications insure that any dust created by the burnishing of the floor will be discharged through the air discharge outlet 84.

When burnishing, the amperage draw can be varied from approximately 55 amps to 85 amps by adjusting the force exerted by spring 142, the spring 142 exerting a greater lifting force when the amperage draw on the batteries is 55 amps. Six 6 volt 370 amp batteries will be sufficient to typically give a full shift of burnishing of well maintained floors. However, if the floors have not been well maintained, the spring force of spring 142 can be progressively decreased until greater force is applied on the floor by the burnisher subassembly, increasing the amperage draw up to approximately 85 amp, which force will typically be sufficient for even poorly maintained floors.

It should be noted that the dust which is discharged through the air discharge outlet 84 will be directed through a flexible hose 178 to a dust collection bag 180 which is removably mounted in the rear shroud **28*r* in front of the removable rear panel 181**.

The Operator Control Means

Figure 3:
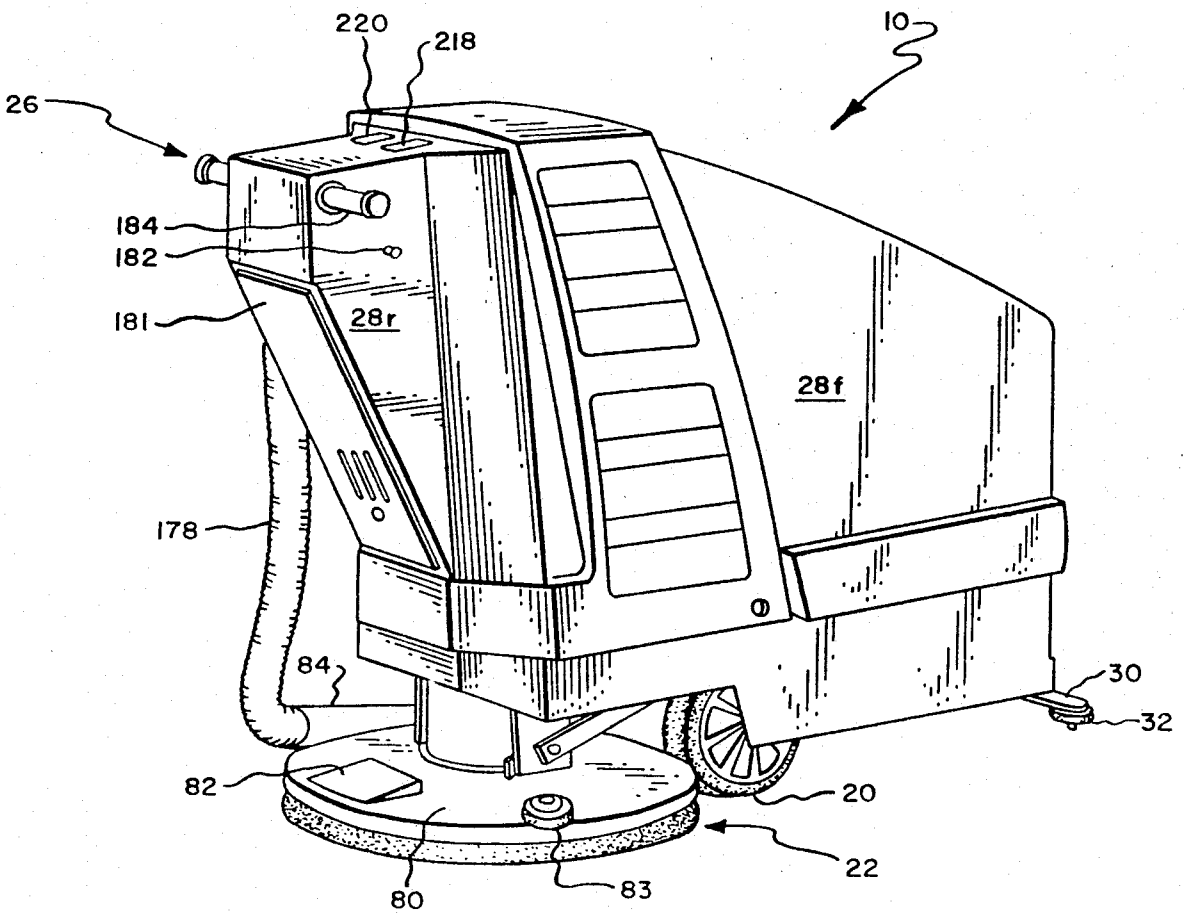
FIG. 3 is a perspective view of the burnisher, this view being taken from the right rear.

The operator control means is mounted in the upper rear portion of shroud 28r and consists essentially of an on/off switch 182 (FIG. 3) and hand grip means 184 which are rotatable about a transverse axis. Thus, the hand grips are mounted on a rotatable shaft 186 (FIG. 1) suitably journaled in the shroud **28*r*, the shaft in turn carrying a rock arm 188 which is interconnected to the rear end of a speed control link 190 by a ball joint construction. The forward end of the speed control rod 190 in turn is connected to the upper end of an arm 192 by a ball joint construction, the lower end of arm 192 being pivoted about cross shaft 194. Also pivoted about the shaft 194 are two scissors links 196 and 198. The ball joint connection between the rod 190 and the arm 192 is provided with a nylon roller 200 which is disposed between the upper ends of the scissors links 196, 198. The lower ends of the scissors links are biased towards each other by a spring 202. The lower ends of the arms 196 and 198 normally are forced into contact with forward and reverse switches 204, 206, which switches are in turn carried by a bracket 208 carried by the shroud 28*r***.

In addition, the machine is provided with a fast forward switch 210 which is mounted on another bracket 212 carried by the rear shroud **28*r*, and a "head down" switch 214 mounted on bracket 216 (FIG. 4) which is in turn carried by the portion 12.4 of the main frame to the left of left bracket 12.8. The switches 204, 206, 210, and 214 are all normally open switches and the switch 214 is only closed when the subassembly 22 is moved from its raised inoperative position to its intermediate ready position, and therefore the switch 214 is referred to as a "head down" switch. The burnisher is additionally provided with an amp meter 218 (FIG. 3) which indicates pad pressure or amperage draw, and may further be provided with an optional battery condition meter 220**. Various other electrical components incorporated within the burnisher of this invention will be described in conjunction with the operation of the machine.

Operation

At the beginning of a shift and after the batteries have been suitably recharged, an operator will turn the key switch 182 from its off or open position to its on or closed position. This will now complete a circuit through the optional battery level meter 220 so that the operator can check the level of the battery to insure that it has been properly recharged. With the hand grips in the neutral position shown in FIG. 1, the operator will next step on the foot pad 82 to force the burnisher subassembly 22 downwardly. It should be noted at this point that one leg 221 of a generally L-Shaped bracket is mounted on the top of motor 24, the other leg 222 extending downwardly in the manner shown. Mounted on the lower end of leg 222 is a stop 223 formed of a carriage screw and acorn nut. When the downwardly moving burnisher subassembly attains the intermediate ready position, the arm 222, which is at a normal angle slightly greater then 90° with respect to arm 221, will spring rearwardly, disposing stop below the lower edge of frame portion 12.6. If the operator now removes his foot from foot pad 82 the springs 140, 142 will maintain the burnisher subassembly in its intermediate ready position with stop 223 bearing against the bottom of frame portion 12.6. As the burnisher subassembly 22 moves downwardly from the raised inoperative position to the intermediate ready position the head-down switch 214 will be contacted by the upper link 126 of the left hand pair of parallel links causing this switch to become closed. When this switch becomes closed the relay 224 will become energized causing the normally closed contact 226 to become open and the normally opened contact 228 to become closed. To cause the pad motor 24 to rotate it is then necessary to switch the hand grip from the neutral position shown in FIG. 1 to either a forward position or a reverse position. If it desired to cause the burnisher 10 to move in a forward direction the hand grip is then turned in a counterclockwise direction in the direction indicated by the arrow f in FIG. 1. This will cause the link 190 to be shifted in a rear direction which will in turn cause link 198 to pivot in a clockwise direction about cross shaft 190 as roller 200 bears against the upper end of the link. As the link 198 moves away from the contact 204 it will become closed thus completing a circuit through the pad motor relay 230 causing the normally open contact 232 to become closed. As both contacts 228 and 232 are now closed, the pad motor 24 will become energized. In addition, the closing of the switch 204 will also cause the forward relay 234 to become energized which will in turn cause the normally closed contact 236 to become open and the normally open contact 238 to become closed. This will additionally cause the motor 66 to be rotated in a forward direction thereby causing the wheel 18 to be rotated in a forward direction. The forward speed is set at a relatively slow speed by means of the speed resistor 240.

The vacuum means becomes operational during normal rotation of the pad motor 24. As the motor 24 rotates the air pressure below the burnisher subassembly 22 will be reduced to such an extent that the partial vacuum below the subassembly will overcome the force exerted by springs 140, 142 forcing the burnisher subassembly downwardly from it intermediate ready position to its lowered burnishing position, it turn forcing the pad into contact with the floor at a pressure which is a function spring pressure and rotational speed of the motor 24. If a portion of the floor should be contacted which will cause the motor to slow down the vacuum will be lessened thereby reducing down pressure and maintaining relatively constant amperage draw. If an open cell pad is not mounted on the burnisher subassembly, the vacuum created by operation of motor 24 will not overcome the spring force exerted by springs 140, 142, and thus there will be insufficient force exerted by the vacuum to shift the subassembly from the ready position to the burnishing position.

If the operator wishes to stop the machine it is only necessary to release the hand grips 184. When this happens the spring 202 will cause link 198 to resume its neutral position in FIG. 1, thus opening the switch 204. When this happens the pad motor relay 230 will become deenergized which will in turn cause contact 232 to become open. At this point the pad motor 24 will start to free wheel until the vacuum force below the pad 114 is insufficient to maintain the burnisher subassembly in its burnishing position. When this happens the springs 140, 142 will shift the burnisher subassembly back to its ready position. It should be obvious that when the hand grip is initially moved back to its neutral position that the burnisher subassembly will not instantly raise as it takes a few moments for the vacuum beneath the pad to decrease sufficiently to cause the burnisher subassembly to be lifted. Therefore, if it is desired to switch the operation of the machine from a forward position to a reverse position, it is only necessary to turn the hand grips in a clockwise position returning link 198 to the position shown in FIG. 1 and moving link 196 away from contact 206 causing this contact to be now closed. This will in turn also complete a circuit through the pad motor relay 230 and will further cause the reverse relay 242 to become energized causing normally closed contact 244 to become open and normally open contact 246 to become closed. When this occurs, the propelling motor 66 will be caused to be rotated in a reverse direction. Again, if the operator should release the hand grip when the unit is in its reverse position, the spring will return the link 196 to the neutral position shown in FIG. 1, and if the hand grip is not turned within a few moments the burnisher subassembly will be shifted to its ready position by springs 140, 142.

In order to shift the burnisher subassembly back to its raised inoperative or transport position it is only necessary for the operator to step on a forward portion of the drive head 80, which will cause the burnisher subassembly to rotate about an axis defined by pivot pin assemblies 136. This will cause the stop 223 to shift forwardly to a position where it is no longer in contact with the lower edge of the frame portion 12.6 permitting the subassembly 22 to be raised by springs 140, 142. In the event that the pad is still rotating when it is desired to raise the subassembly to its transport position, the switch 214 will be opened during the raising movement, causing contact 226 to become closed, thereby shorting the motor and dynamically braking the unit.

It may be desired to transport the unit from one location to another when the burnisher is in its raised position. In order to transport at higher speeds, a fast forward switch 210 is provided and when this switch is closed by rotating hand grips 184 to their full forward position the propelling motor 66 will be caused to be operated at an even higher speed. Service to the burnisher pad will be performed when the subassembly is in its raised position, as shown in phamton lines in FIG. 7.

While the burnisher of this invention has been described so far as a self-propelled machine, it may be desirable in some situations to provide a lower cost model without the drive motor 66. In this situation, not only will the propelling motor 66 be eliminated, but the forward and reverse relays will also be eliminated. However, a forward switch 204 will be incorporated into the machine to insure that the unit will not rotate unless the operator has moved the hand grips 184 from their neutral position to a forward position. Thus, in the event that the operator should walk away from the machine while the burnisher subassembly is down and rotating, a spring similar to that shown at 202 will cause the hand grip to be returned back to a neutral position thus deenergizing the pad motor relay which will in turn cause the current to the pad motor 24 to be interrupted. As the pad motor slows down the vacuum under the subassembly 22 will reduced, thus permitting the subassembly to be raised by springs, 140, 142 to its ready position.

It should be appreciated from the above that the burnisher of the present invention overcomes many of the advantages of known prior art burnishers.

While a preferred structure in which the principles of the present invention have been incorporated is shown and described above, it is to be understood that this invention is not to be limited to the particular details shown and described above, but that, in fact, widely differing means may be employed in the broader aspects of this invention. For example, many of the principles of this invention may be applied to floor maintenance machines other than battery powered floor burnishers.

What is claimed is:

1. A floor burnisher comprising:

a frame;

wheel means supporting the frame for movement over a floor;

a burnisher subassembly, said burnishing subassembly including a drive head provided with a pair of laterally spaced apart upwardly extending brackets, each bracket being provided with a pair of vertically spaced apart pivot pin receiving apertures one of said pair of pivot pin receiving apertures being elongated;

linkage means extending between the frame and the burnisher subassembly for supporting the burnisher subassembly upon the frame for movement between either a raised inoperative position or a lowered operative position, the linkage means including two pair of laterally spaced apart parallel links pivotally connected at the forward ends to the frame and pivotally connected at their rear ends to the laterally spaced apart upwardly extending brackets by pivot pins which extend into said apertures;

a burnishing pad carried by the burnishing subassembly; and drive means interconnected with the burnishing pad and capable of rotating the burnishing pad.

2. The floor burnisher as set forth in claim 1 wherein each bracket is mounted on said drive head by rubber bushings, said bushings offering vibration isolation and permitting additional float of the burnisher subassembly.

3. A floor burnisher comprising:

a frame;

wheel means supported by the frame for movement over the floor;

a burnisher subassembly;

linkage means extending between the frame and the burnisher subassembly for supporting the burnisher subassembly on the frame for movement from a raised inoperative position through an intermediate ready position to a lowered operative position;

biasing means biasing the burnisher subassembly with an upward force;

drive means;

vacuum means carried by the burnisher subassembly and interconnected with the drive means, the vacuum means being an open cell burnishing pad rotatably carried by the burnishing subassembly, the vacuum means exerting a downward force greater than the upward force exerted by the biasing means when the vacuum means is operatively driven by the drive means; and stop means extending between the burnisher subassembly and the frame, said stop means being capable of maintaining the burnisher subassembly in said ready position, the vacuum means being capable of causing movement of the burnisher subassembly from its intermediate ready position to its lowered position when the vacuum means is driven.

4. The floor burnisher as set forth in claim 3 wherein the burnisher subassembly is provided with a foot pad engageable by an operators foot, said operator being capable of moving the burnisher subassembly from its raised inoperative position to the intermediate ready position by stepping on the foot pad with a force greater than that exerted by said biasing means, said stop means normally maintaining the burnisher subassembly in the intermediate position when the vacuum means is not being operated, or when the vacuum means is not mounted on the burnisher subassembly.

5. The floor burnisher as set forth in claim 3 wherein the burnisher subassembly is mounted on the linkage means for tilting movement about a transversely disposed axis, and wherein the stop means can be released by tilting a forward portion of the burnisher subassembly downwardly.

6. A floor burnisher comprising:

a main frame;

wheel means supporting the main frame for movement over a floor;

a burnisher subassembly laterally offset to one side of the longitudinal center line of the main frame;

a burnishing pad carried by the burnishing subassembly;

drive means interconnected with the burnishing pad and capable of rotating the burnishing pad; and mounting means including linkage means extending between the main frame and the burnisher subassembly for mounting the burnisher subassembly on the frame to the rear of the wheel means for movement between raised and lowered positions.

7. The walk behind burnisher as set forth in claim 6 wherein the wheel means includes a front caster wheel and a pair of laterally spaced apart wheels immediately forward of the burnisher subassembly and to either side of the longitudinal centerline, that laterally spaced apart wheel which is to said one side of the longitudinal center line of the main frame being disposed further to the front of the machine than the other laterally spaced apart wheel.

8. The walk behind floor burnisher as set forth in claim 6 wherein the wheel means includes a front caster wheel and a pair of laterally spaced apart wheels, at least one of the laterally spaced apart wheels being driven.

9. A battery powered walk behind floor burnisher comprising:

a main frame capable of supporting a plurality of batteries;

wheel means supporting the main frame for movement over a floor;

a burnisher subassembly;

a burnishing pad carried by said subassembly;

battery driven drive means interconnected with the burnishing pad and capable of rotating the burnishing pad;

mounting means including linkage means extending between the main frame and the burnisher subassembly for mounting the burnisher subassembly on the frame to the rear of the wheel means for movement from a raised inoperative position through an intermediate ready position to a lowered operative position; and operator control means mounted on a rear portion of the main frame and disposed above the burnisher subassembly, said control means including switch means capable of sensing movement of the burnisher subassembly as it is moved from its raised operative position to its intermediate ready position, said switch means permitting the battery driven drive means to be powered up when the burnisher subassembly is in its intermediate or lowered operative positions, but not when it is in its raised position.

10. The battery powered walk behind floor burnisher as set forth in claim 9 further characterized by the provision of means to dynamically brake the battery driven drive means when the burnisher subassembly is raised from its intermediate ready position to its raised inoperative position.

11. A battery powered walk behind floor burnisher comprising:

a main frame capable of supporting a plurality of batteries;

drive wheel means supporting the main frame for movement over a floor;

battery driven drive means interconnected with and capable of rotating the drive wheel means;

a burnisher subassembly;

mounting means including linkage means extending between the main frame and the burnisher subassembly for supporting the burnisher subassembly on the main frame to the rear of the wheel means for movement between either raised and lowered positions; and operator control means mounted on a rear portion of the main frame above the burnisher subassembly, said operator control means including a hand grip rotatable about a transverse axis and shiftable between a neutral position, a first forward speed position, and a second higher forward speed to cause corresponding movement of the drive wheel means.

12. The battery powered walk behind floor burnisher as set forth in claim 4 wherein the mounting means further includes biasing means interconnected with the linkage means and further of maintaining the burnisher subassembly in the raised inoperative position;

wherein vacuum means are provided, the vacuum means being carried by the burnisher subassembly and being capable of maintaining the subassembly in contact with the floor when the vacuum means is rotatably driven, the vacuum means exerting a force greater than force exerted by the biasing means when rotatably driven; and wherein the control means includes means to return the hand grip to its neutral position when disengaged, and further including means to power up the battery driven drive means only when the hand grip is in either a reverse position or one of its two forward speed positions, the parts being so arranged and constructed that if the operator should release the hand grip, the hand grip will be returned to its neutral position causing the battery driven drive means not to be driven.

13. The battery powered walk behind floor burnisher as set forth in claim 11 wherein the hand grip is further shiftable to a reverse position.

14. A floor burnisher comprising:

a main frame;

wheel means supporting the main frame for movement over a floor;

a burnisher subassembly;

vacuum means carried by the burnisher subassembly, said vacuum means consisting essentially of only an open cell rotatable burnishing pad;

mounting means including linkage means extending between the main frame and the burnisher subassembly for mounting the burnisher subassembly on the main frame for movement between either a raised inoperative position or a lowered relative position;

biasing means interconnected with the burnisher subassembly and biasing the burnisher subassembly with an upward force; and drive means interconnected with the vacuum means, the drive means being inoperative when the burnisher assembly is in its raised inoperative position, but being operative and capable of rotating the burnishing pad when the burnisher subassembly is in its lowered operative position, the vacuum means when rotated exerting a downward force greater than the upward force exerted by the biasing means whereby the vacuum means will cause the burnisher subassembly to be maintained in its lowered operative position.

15. The floor burnisher as set forth in claim 14 wherein the burnisher subassembly is mounted on the main frame to the rear of the wheel means, and further characterized by the provision of operator control means carried by a rear portion of the main frame above the burnisher subassembly.

16. A floor burnisher comprising:

a frame;

wheel means supporting the frame for movement over a floor;

a burnisher subassembly including a circumferentially flanged drive head and a rotatable drive block disposed within the drive head;

vacuum means and dust collecting means carried at least in part by the burnisher subassembly, the dust collecting means including an outlet on the drive head and a dust bag interconnected with said outlet; and drive means interconnected with the drive block and capable of rotating the drive block;

characterized by the vacuum means consisting essentially of only an open cell burnishing pad carried by the drive block, and the dust collecting means including a single peripheral rubber skirt, an upper portion of which is secured to the circumferential flange of the drive head, the skirt further being provided with a lower bellows-shaped portion which insures good conformability with the floor to insure that the very bottom edge of the skirt is maintained in contact with the floor, the skirt providing a seal to the floor and allowing any dust which may be created by the burnishing pad to be confined within the skirt, additional air and dust being pulled under the skirt as the skirt additionally acts as an air valve which controls the vacuum under the burnisher subasssembly.

17. The floor burnisher as set forth in claim 16 wherein the bellows-shaped portion of the skirt is curved in cross section, the lower edge of the bellows-shaped portion extending radially downwardly and inwardly when viewed in cross section.

* * * * *